US011807347B2

(12) United States Patent
Lee

(10) Patent No.: US 11,807,347 B2
(45) Date of Patent: Nov. 7, 2023

(54) PORTABLE INFLATABLE DIVING FLOAT

(71) Applicants: LEON SPORTS LTD., Jiangsu (CN); William Lee, Taipei (TW)

(72) Inventor: William Lee, Taipei (TW)

(73) Assignees: LEON SPORTS LTD., Jiangsu (CN); William Lee, Taipei (TW)

( * ) Notice: Subject to any disclaimer, the term of this patent is extended or adjusted under 35 U.S.C. 154(b) by 735 days.

(21) Appl. No.: 16/944,246

(22) Filed: Jul. 31, 2020

(65) Prior Publication Data

US 2021/0206461 A1 Jul. 8, 2021

(30) Foreign Application Priority Data

Jan. 7, 2020 (TW) ..... 109200255

(51) Int. Cl.
*B63C 11/26* (2006.01)
*B63C 13/00* (2006.01)
*A45F 3/15* (2006.01)

(52) U.S. Cl.
CPC ..... *B63C 11/26* (2013.01)

(58) Field of Classification Search
CPC ..... B63C 11/26; B63C 13/00; A45F 3/15
See application file for complete search history.

(56) References Cited

U.S. PATENT DOCUMENTS 3,123,840 A * 3/1964 Cefalo, Jr. ..... B63B 34/10 114/354
5,474,481 A * 12/1995 Ramsey ..... B63C 13/00 224/406

FOREIGN PATENT DOCUMENTS

DE 3204420 A1 * 8/1983 ..... B63C 13/00

* cited by examiner

*Primary Examiner* — Stephen P Avila
(74) *Attorney, Agent, or Firm* — Muncy, Geissler, Olds & Lowe

(57) ABSTRACT

A portable inflatable diving float that includes an inflatable float body is revealed. The float body consists of a horizontal portion provided with a left folding area formed on the left side and a right folding area formed on the right side. After the left and the right folding area being folded to a middle portion of the float body, a left edge portion of the left folding area and a right edge portion of the right folding area are connected by a first connection member and kept in the folded state. A flat body formed after deflation of the float body becomes a backpack body with smaller area. At least one strap member is connected between the top end and the bottom end on a front side or a back side of the float body so that users can carry the backpack body on their back.

10 Claims, 11 Drawing Sheets

PORTABLE INFLATABLE DIVING FLOAT

BACKGROUND OF THE INVENTION

The present invention relates to a diving float, especially to a portable inflatable diving float.

Free-diving is one of the most popular recreational activities today. On attractions near the coast, free-divers carry inflatable diving floats with them. Although a conventional inflatable diving float (float body) can be carried on the user's back (such as the float body 2 shown in FIG. 10), the horizontal length/diameter of the float body is about 70 centimeters (as the arrow in FIG. 10 indicates). The length/diameter is larger than the width of the user's back so that the user is unable to be moved freely in the crowded area (such as prosperous markets) or in a cramped space (such as a bus compartment). Since the conventional inflatable diving float (float body) has the shortcoming of low portability, there is room for improvement and there is a need to provide a novel portable inflatable diving float.

SUMMARY OF THE INVENTION

Therefore it is a primary object of the present invention to provide a portable inflatable diving float in which a left folding area and a right folding area are respectively formed on the left side and the right side of a horizontal portion of a float body thereof. After being folded toward the middle of the float body, the left folding area and the right folding area are connected by a first connection member and kept in the folded state. Thereby a flat body formed after deflation of the float body is folded into a backpack body with smaller area. Moreover, at least one strap member is disposed between the top and the bottom ends on a front side or a back side of the float body so that users can carry the backpack body on their back with them. Thereby the poor portability problem of the conventional portable inflatable diving float (float body) has been solved effectively.

In order to achieve the above object, a portable inflatable diving float according to the present invention includes a float body able to be blown up. After being deflated, the float body becomes a flat body. The flat body is defined to include a horizontal portion, a vertical portion and a middle portion which is an intersection of the horizontal portion and the vertical portion. The left side and the right side of the horizontal portion of the float body are symmetrical to each other. A left folding area and a right folding area are respectively formed on the left side and the right side of the horizontal portion of the float body for being folded toward the middle portion. The horizontal length of the horizontal portion is reduced when the left folding area and the right folding area are simultaneously folded toward the middle portion and kept in the folded state. After the left folding area and the right folding area being folded over the middle portion, a left edge portion of the left folding area and a right edge portion of the right folding area are connected by a first connection member. Thereby the left folding area and the right folding area are kept in the folded state over the middle portion. Thus the flat body formed after deflation of the float body further becomes a backpack body with smaller area. At least one strap member is connected between the top end and the bottom end on a front side or a back side of the float body. Thus users can carry the backpack body formed by the folded flat body on their back with them by the strap member.

Preferably, the strap member includes two straps extending from the top end to the bottom end of the backpack body and arranged symmetrically to each other. Thereby a user can carry the portable inflatable diving float on the back by the two straps which go over the left should and the right shoulder of the user respectively.

Preferably, when the left edge portion of the left folding area and the right edge portion of the right folding area are connected by the first connection member and kept in the folded state, the left edge portion of the left folding area and the right edge portion of the right folding area can be against each other, arranged symmetrical to and spaced apart from each other, or overlapped with each other.

Preferably, the first connection member can be designed into different types such as a side release buckle, a hook-and-loop fastener, or a button.

Preferably, the respective types of the first connection member can be formed by a male part and a female part respectively arranged at the left edge portion of the left folding area and the right edge portion of the right folding area.

DETAILED DESCRIPTION OF THE PREFERRED EMBODIMENTS

In order to learn structure and technical features of the present invention, please refer to the following embodiments together with the related figures.

Figure 5:
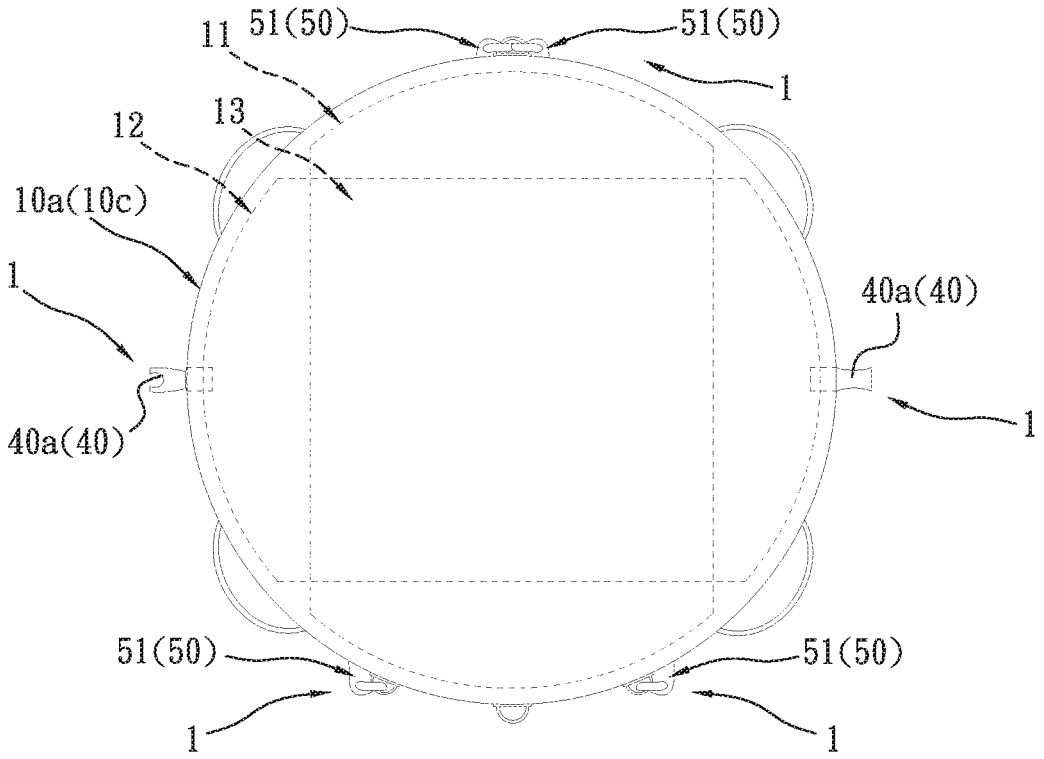
FIG. 5 is a schematic drawing showing a top view of the embodiment in FIG. 1 in a flat state according to the present invention.

Refer to FIG. 1-9 and FIG. 11-21, two embodiments of a portable inflatable diving float according to the present invention are revealed. The portable inflatable diving float 1 of the present invention includes a float body 10 which is able to be blown up and provided with at least one inflation valve 20 and at least one deflation valve 30. The inflation valve 20 enables users to blow up (as the arrow A in FIG. 3 indicates) the inflatable float body 10, as shown in FIG. 1-3 and FIG. 15 while the deflation valve 30 allows users to release gas from the inflatable float body 10 (as the arrow B in FIG. 4 indicates) so that the inflatable float body 10 becomes a flat body 10*a*, as shown in FIG. 4-6, FIG. 16 and FIG. 17. Refer to FIG. 5 and FIG. 16, the flat body 10*a* is defined to include a horizontal portion 11, a vertical portion 12, and a middle portion 13 which is an intersection of the horizontal portion 11 and the vertical portion 12. The left side and the right side of the horizontal portion 11 of the float body 10 are symmetrical to each other, but not limited.

Figure 6:
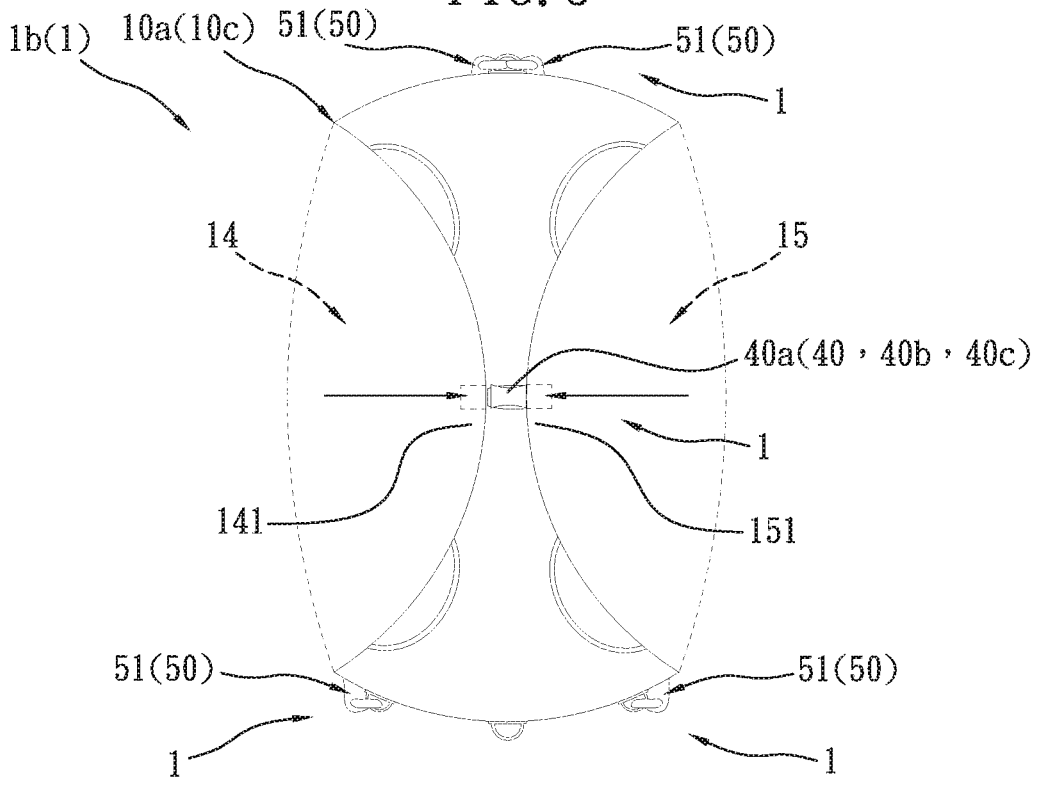
FIG. 6 is a schematic drawing showing a top view of the embodiment in FIG. 5 during folding according to the present invention.
Figure 7:
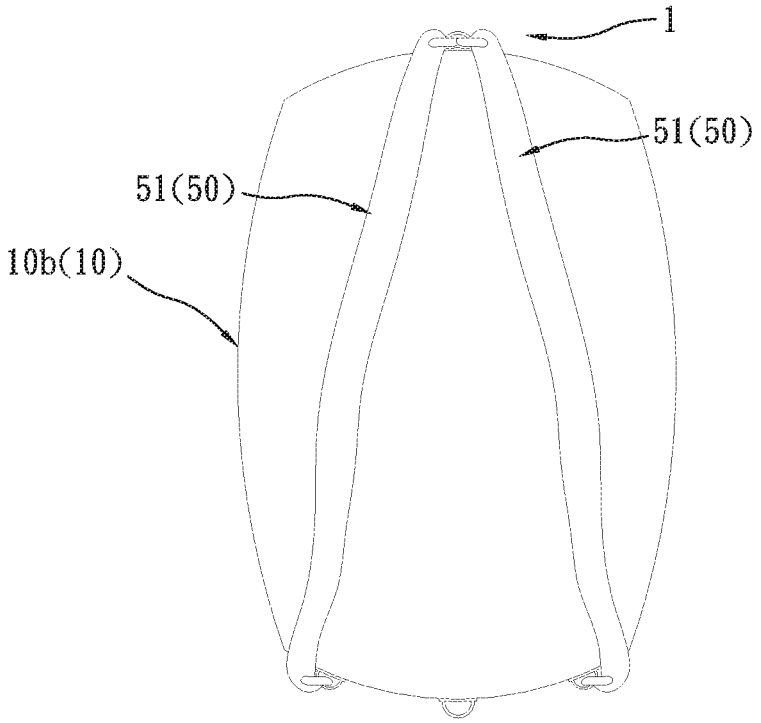
FIG. 7 is a schematic drawing showing a bottom view of the embodiment in FIG. 6 already folded and having straps on a back side thereof (backpack body) according to the present invention.
Figure 8:
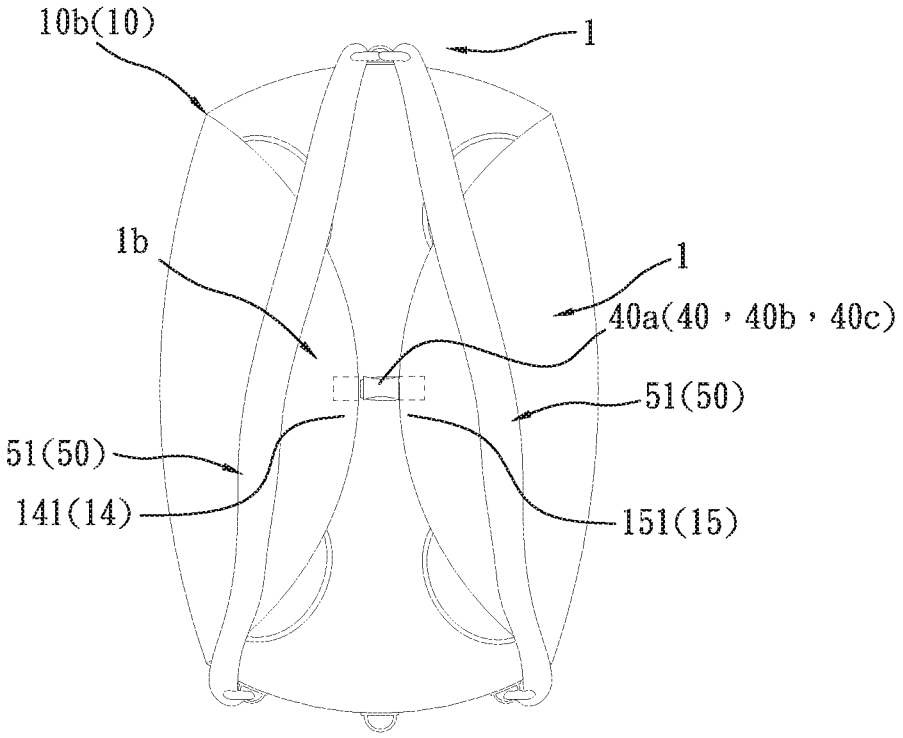
FIG. 8 is a schematic drawing showing a top view of the embodiment in FIG. 6 already folded and having straps on a front side thereof (backpack body) according to the present invention.
Figure 16:
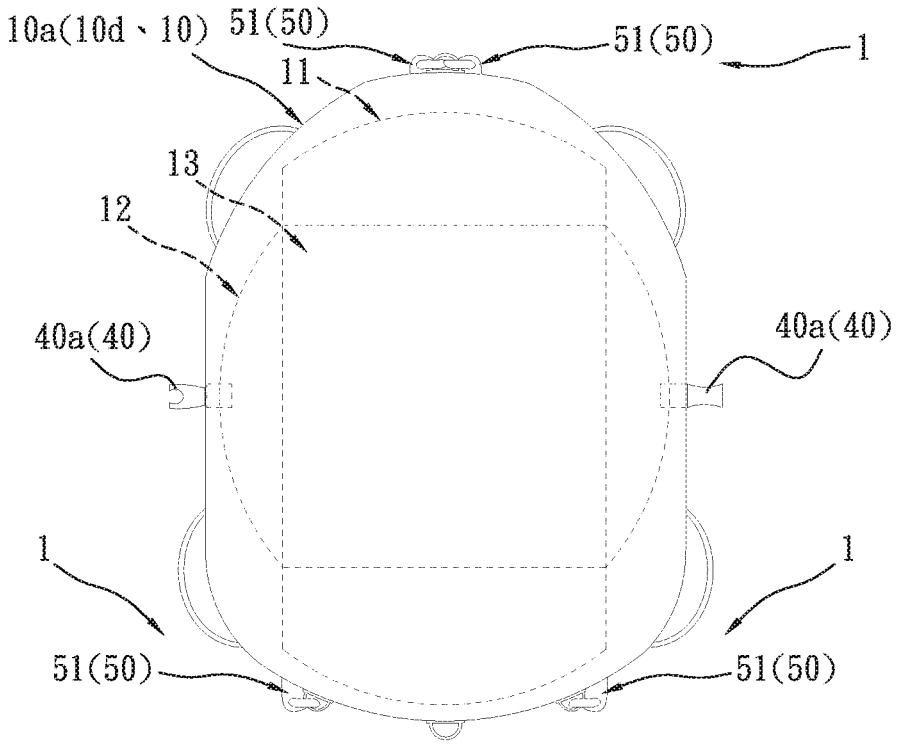
FIG. 16 is a schematic drawing showing a top view of the embodiment in FIG. 15 already become a flat body according to the present invention.
Figure 17:
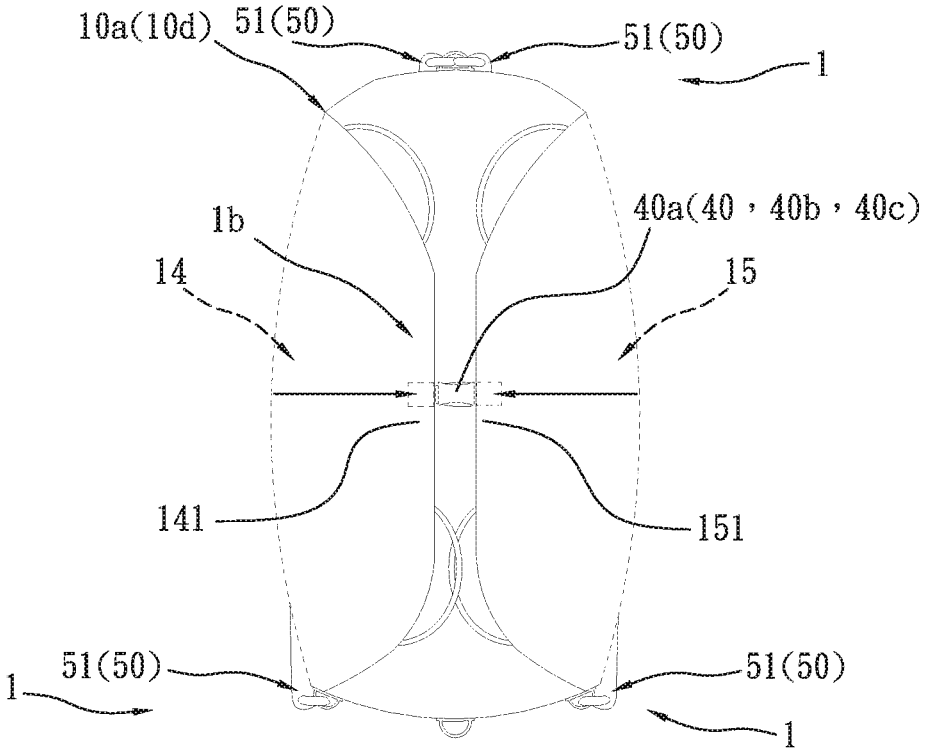
FIG. 17 is a schematic drawing showing a top view of the embodiment in FIG. 15 during folding according to the present invention.
Figure 18:
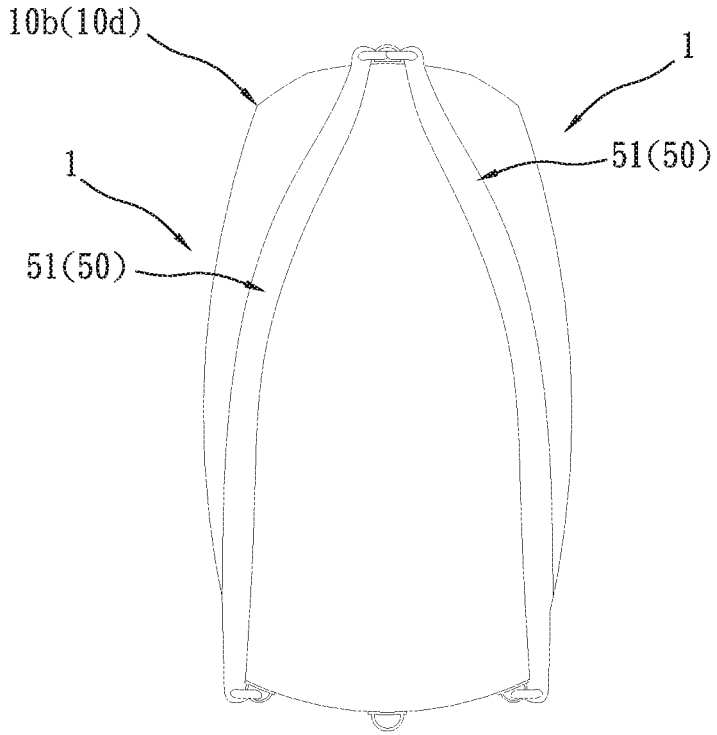
FIG. 18 is a schematic drawing showing a bottom view of the embodiment in FIG. 15 already folded and having straps on a back side thereof (backpack body) according to the present invention.
Figure 19:
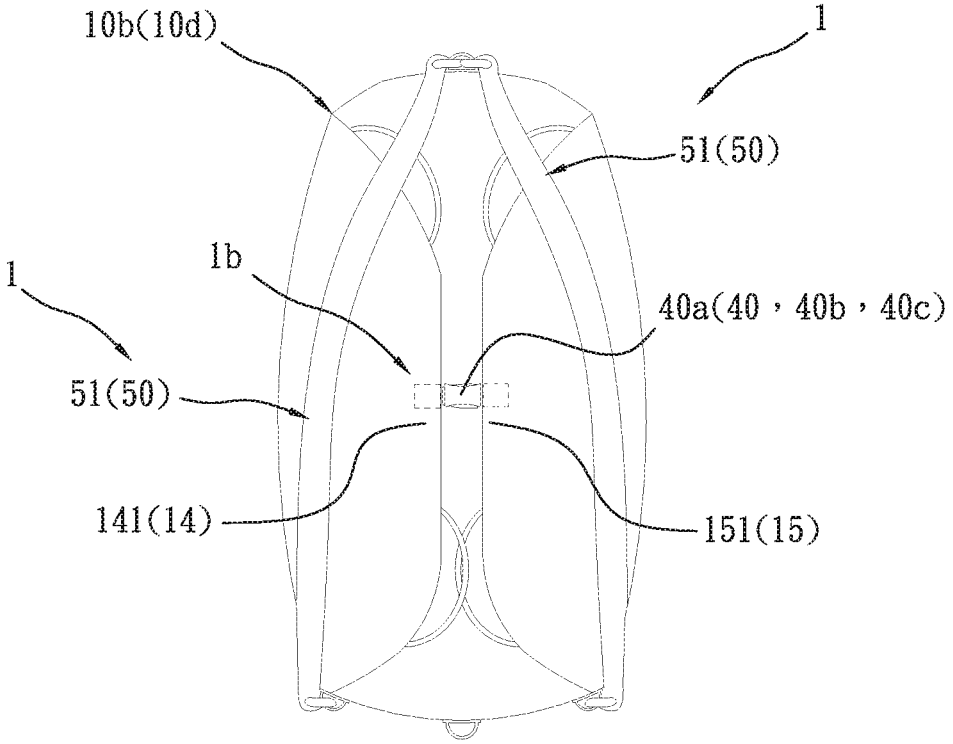
FIG. 19 is a schematic drawing showing a top view of the embodiment in FIG. 15 already folded and having straps on a front side thereof (backpack body) according to the present invention.

Refer to FIG. 5 and FIG. 16, a left folding area 14 and a right folding area 15 are respectively formed on the left side and the right side of the horizontal portion 11 of the float body 10 for being folded toward the middle portion 13 (as shown in FIG. 6 and FIG. 17). The horizontal length of the horizontal portion 11 is reduced when the left folding area 14 and the right folding area 15 are simultaneously folded toward the middle portion 13 and kept in the folded state.

As shown in FIG. 6-8, FIG. 11-14 and FIG. 17-21, after the left folding area 14 and the right folding area 15 being folded over the middle portion 13, a left edge portion 141 of the left folding area 14 and a right edge portion 151 of the right folding area 15 are connected by a first connection member 40. Thereby the left folding area 14 and the right folding area 15 are kept in the folded state over the middle portion 13. Thus the flat body 10*a* formed after deflation of the float body 10 further becomes a backpack body 10*b* with smaller area.

Figure 9:
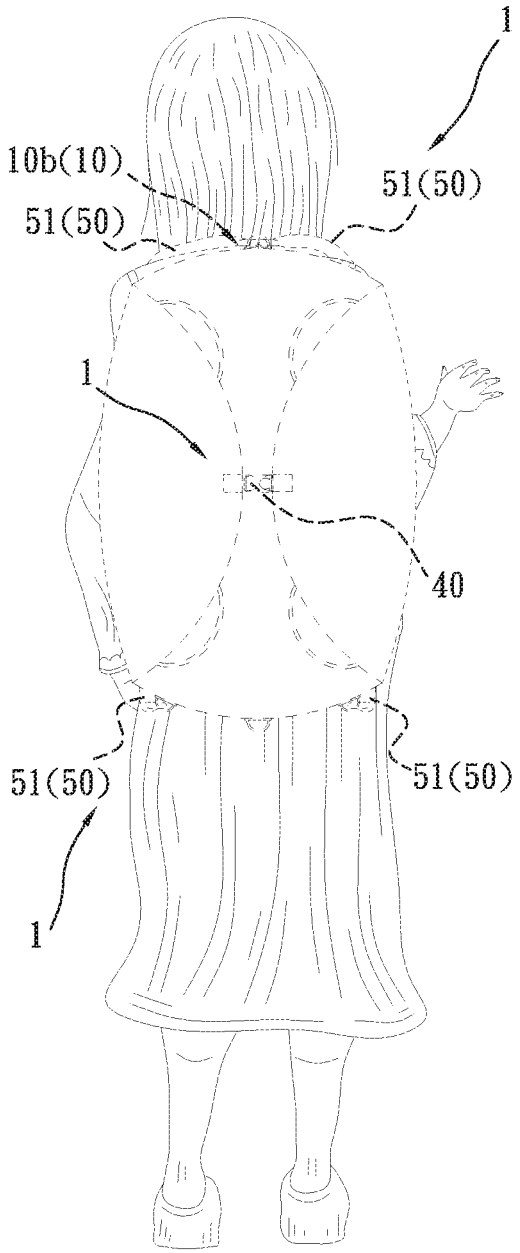
FIG. 9 is a schematic drawing showing an embodiment of the present invention carried by a user.
Figure 10:
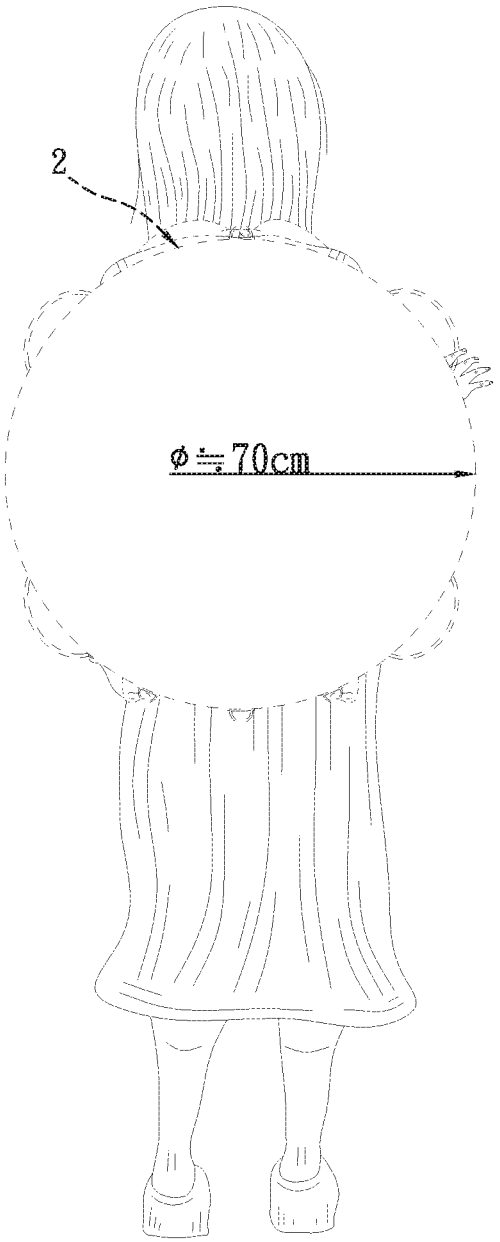
FIG. 10 is a schematic drawing showing a conventional floatation aid/float carried by a user.
Figure 11:
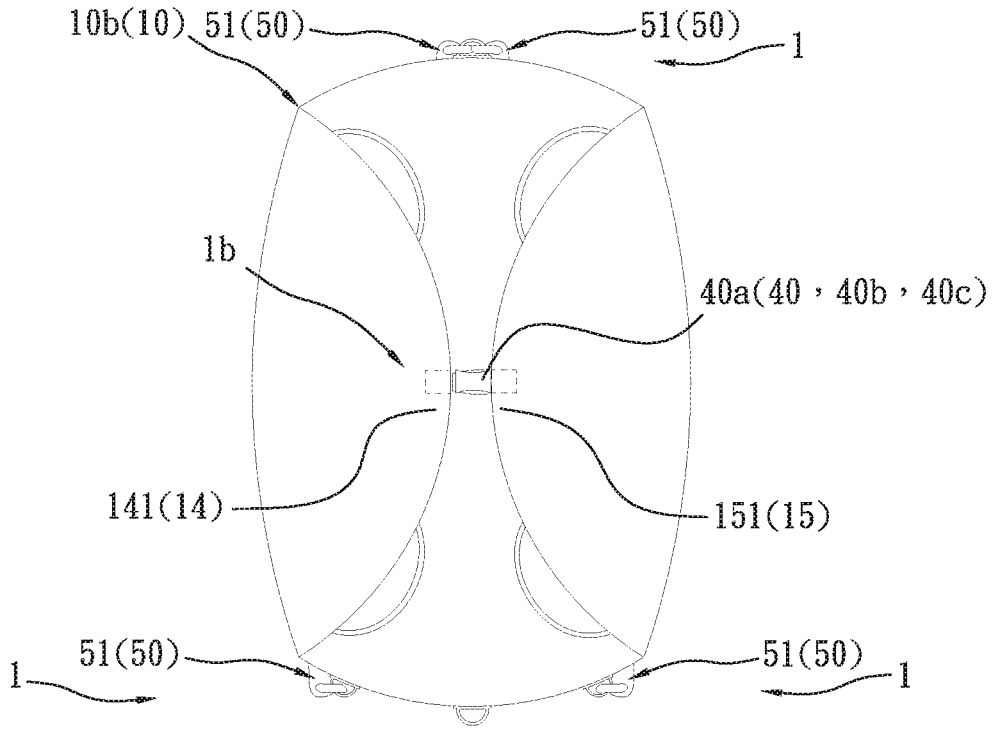
FIG. 11 is a top view of the embodiment in FIG. 6 after being folded according to the present invention.

As shown in FIG. 7, FIG. 8, FIG. 13, FIG. 14, FIG. 18, and FIG. 19 at least one strap member 50 is connected between the top end and the bottom end on a front side or a back side of the float body 10. Thus users can carry the backpack body 10*b* formed by the folded flat body 10*a* on their back with them by the strap member 50, as shown in FIG. 9.

Figure 1:
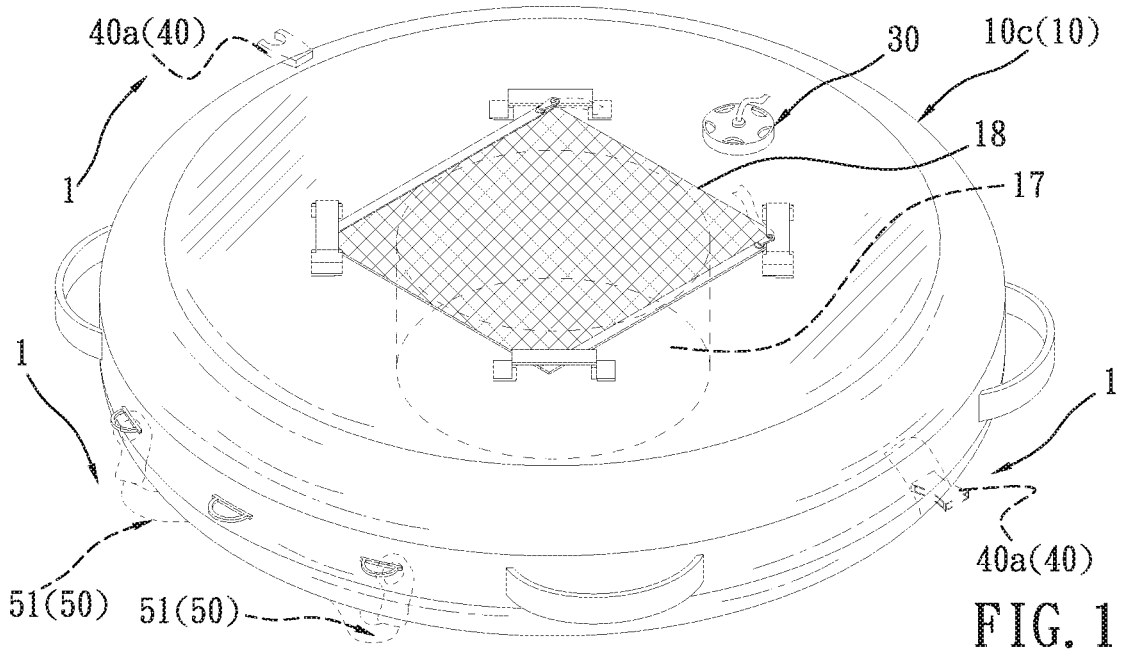
FIG. 1 is a perspective view of an embodiment (a circular flotation aid/float) according to the present invention.
Figure 2:
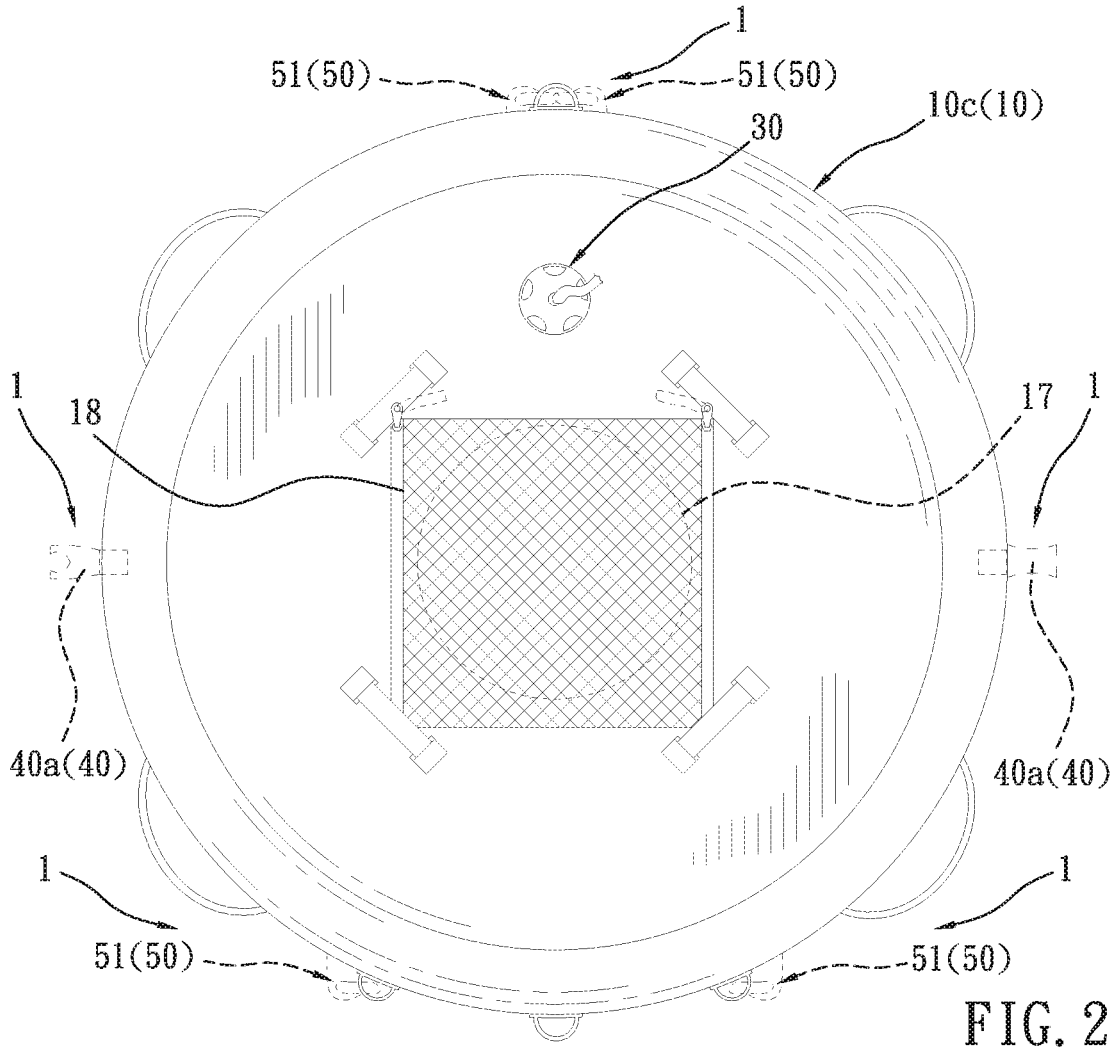
FIG. 2 is a top view of the embodiment in FIG. 1.
Figure 3:
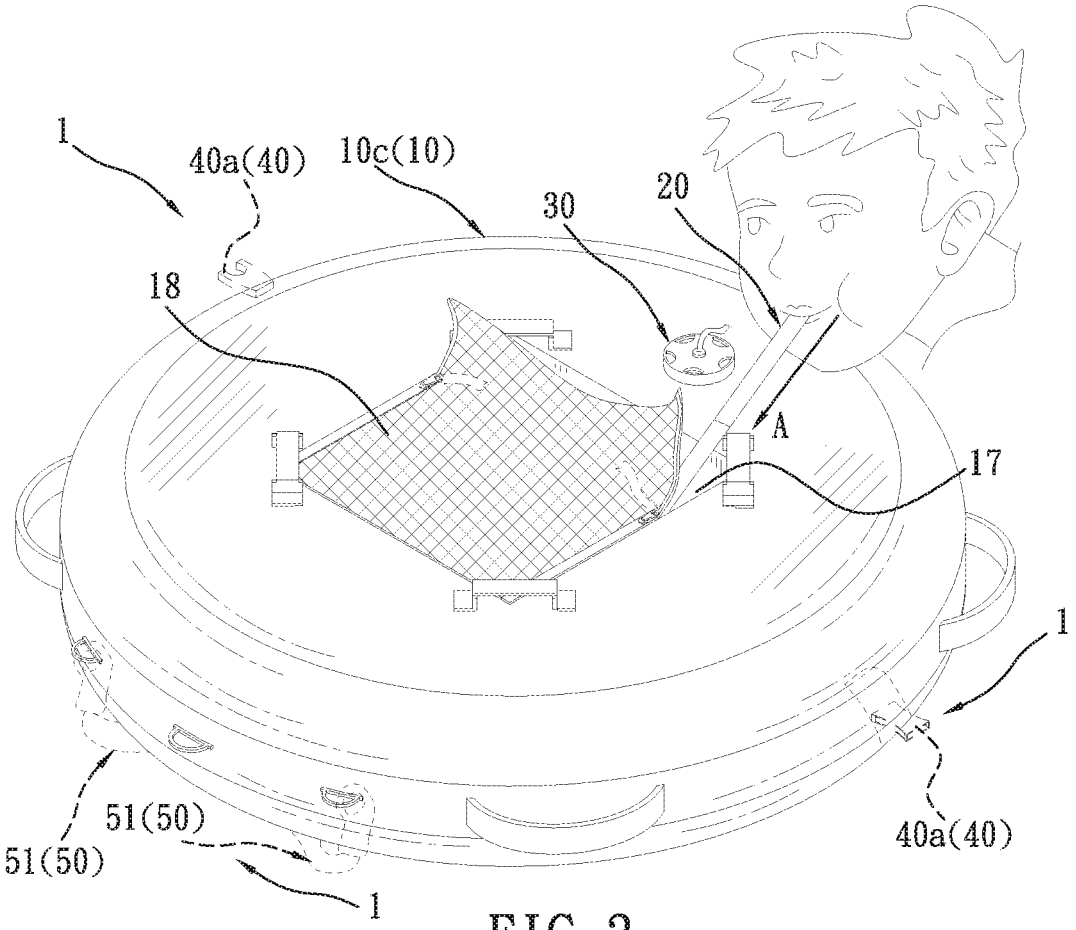
FIG. 3 is a perspective view showing a user blowing up a flotation aid according to the present invention.
Figure 4:
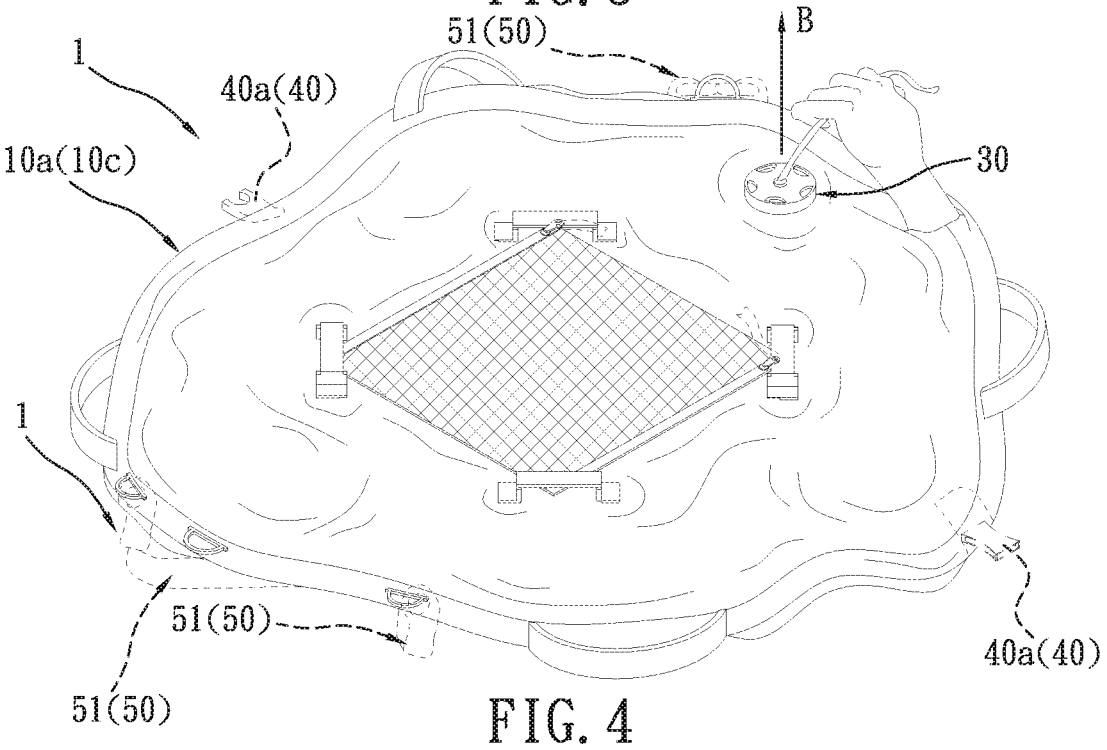
FIG. 4 is a perspective view showing deflation of a flotation aid according to the present invention.
Figure 15:
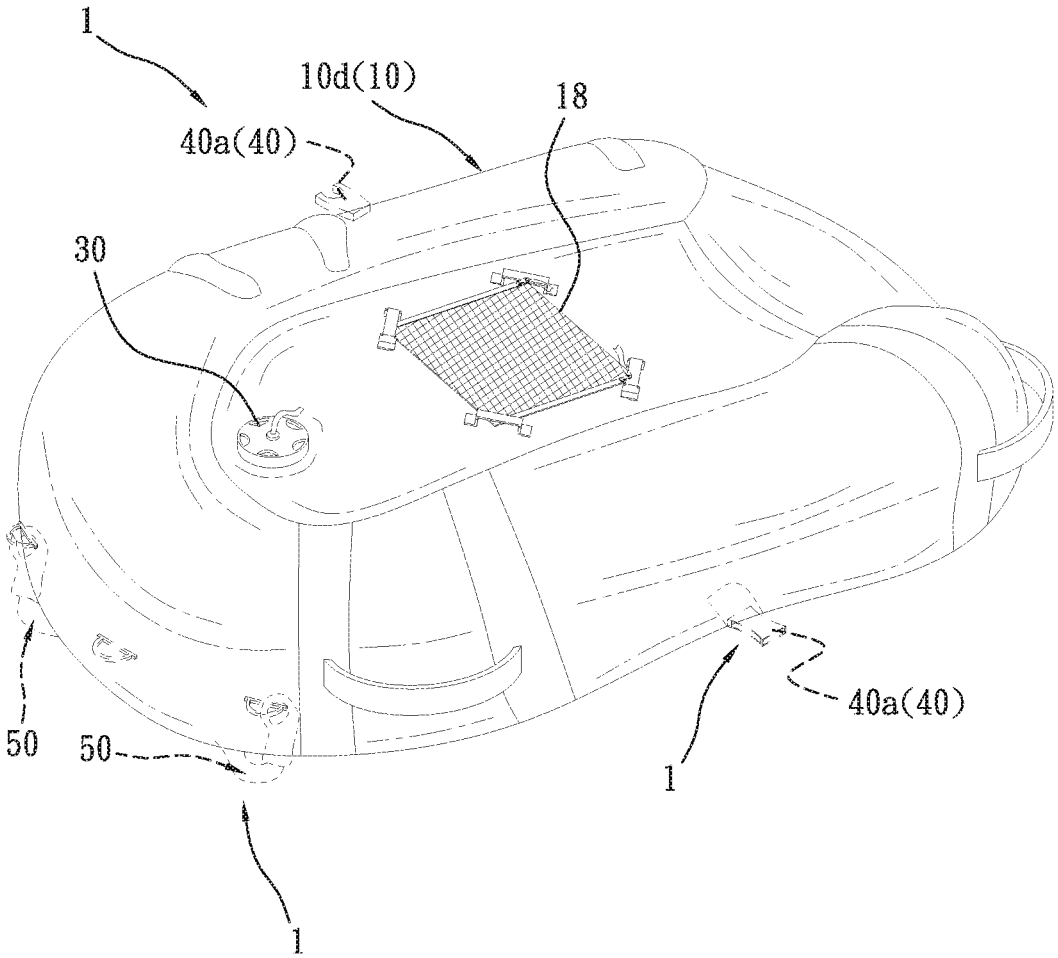
FIG. 15 is a perspective view of another embodiment (a U-shaped float body) according to the present invention.

Refer to FIG. 1 and FIG. 15, a pull ring or a handle is disposed on the periphery of the float body 10 so that users can hold objects on the float body 10 or grip the float body 10 to float on the water during free-diving.

Refer to FIG. 7, FIG. 8, FIG. 13, FIG. 14, FIG. 18, and FIG. 19, the strap member 50 includes two straps extending from the top end of the backpack body 10*b* to the bottom end of the backpack body 10*b* and arranged symmetrically to each other. Thereby users can carry the portable inflatable diving float 1 on their back by the two straps 51 which go over their left should and the right shoulder respectively, as shown in FIG. 9.

Figure 20:
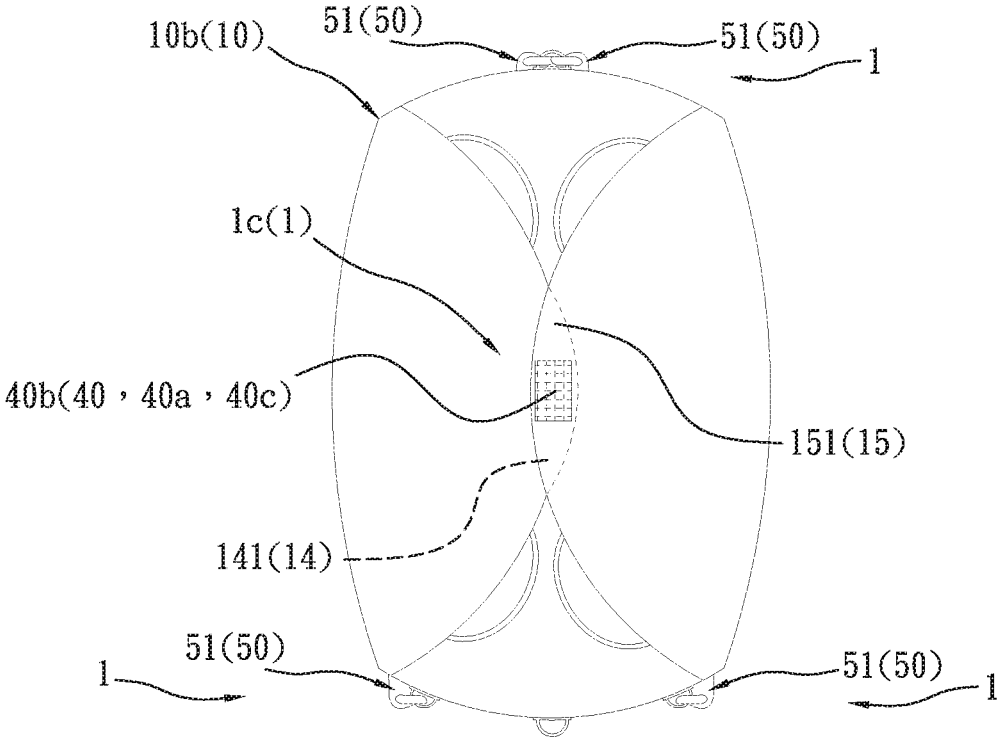
FIG. 20 is a schematic drawing showing a top view of an embodiment in which a part of the left side and a part of the right side are overlapped according to the present invention.
Figure 21:
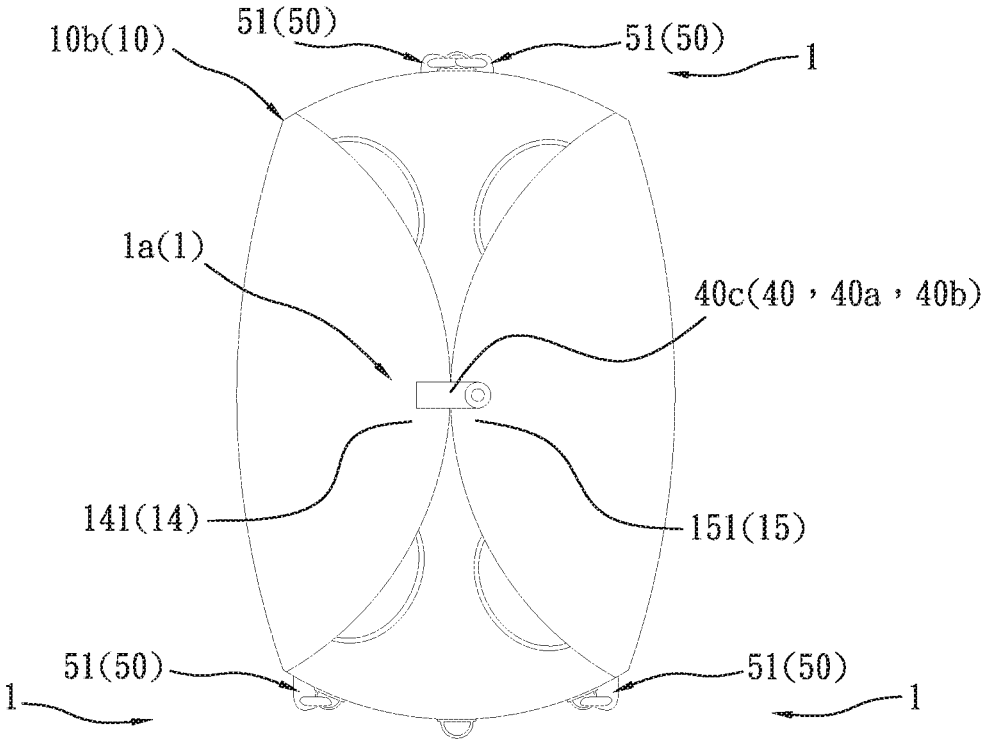
FIG. 21 is a schematic drawing showing a top view of an embodiment in which a part of the left side and a part of the right side are against each other according to the present invention.

Refer to FIG. 8, FIG. 11, FIG. 12, FIG. 14, and FIG. 19-21, when the left edge portion 141 of the left folding area 14 and the right edge portion 151 of the right folding area 15 are connected by the first connection member 40 and kept in the folded state, the left edge portion 141 of the left folding area 14 and the right edge portion 151 of the right folding area 15 can be against each other 1*a* (as shown in FIG. 21), arranged symmetrical to and spaced apart from each other 1*b* (as shown in FIG. 8, FIG. 11, FIG. 12, FIG. 14, and FIG. 19), or overlapped with each other 1*c* (as shown in FIG. 20).

The first connection member 40 can be designed into different types such as a side release buckle 40*a* (as shown in FIG. 8, FIG. 11, FIG. 12, FIG. 14, and FIG. 19), a hook-and-loop fastener 40*b* (as shown in FIG. 20), or a button 40*c* (as shown in FIG. 21). The respective types of the first connection member 40 can be, but not limited, formed by a male part and a female part respectively disposed on the left edge portion 141 of the left folding area 14 and the right edge portion 151 of the right folding area 15. The side release buckle 40*a*, the hook-and-loop fastener 40*b*, or the button 40*c* are generally known to people skilled in the art so that they are not described in details and shown in figures.

Figure 12:
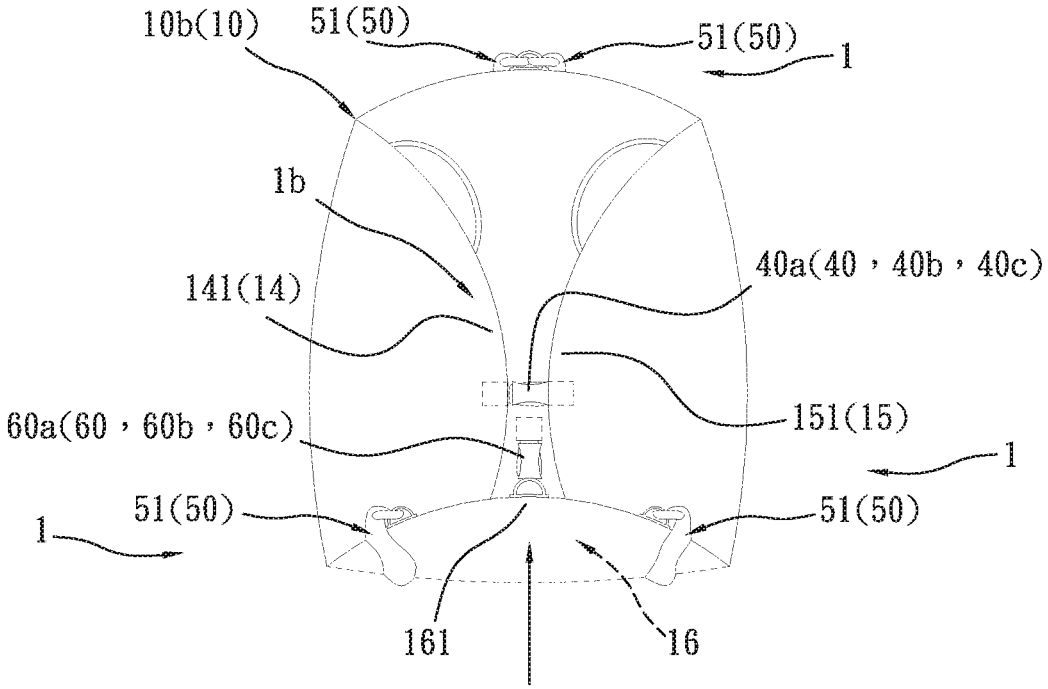
FIG. 12 is a top view of the embodiment in FIG. 11 in which a lower side of a middle portion is folded upward according to the present invention.
Figure 13:
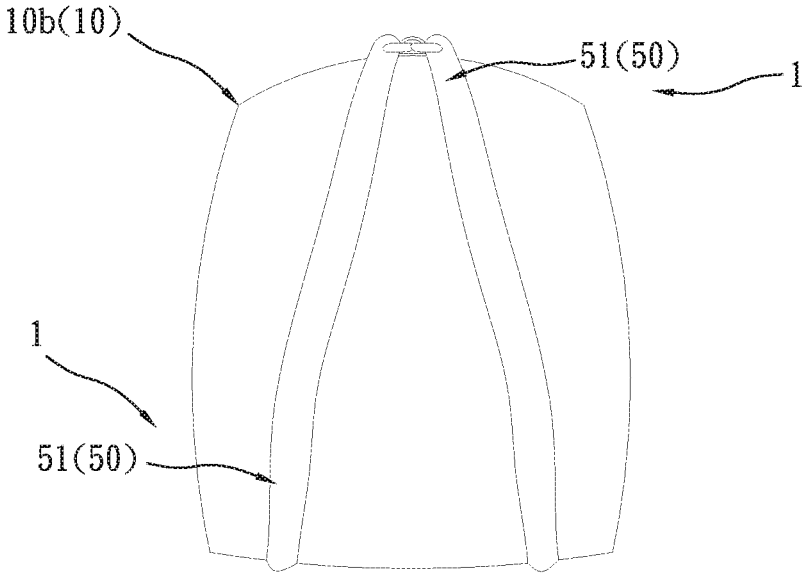
FIG. 13 is a bottom view of the embodiment in FIG. 11 already folded and having straps on a back side thereof (backpack body) according to the present invention.

Refer to FIG. 5 and FIG. 12, a bottom side of the middle portion 13 of the float body 10 can be folded upward to form a bottom folding area 16. When the bottom folding area 16 has been folded toward the middle portion 13, the vertical length of the vertical portion 12 is reduced.

Figure 14:
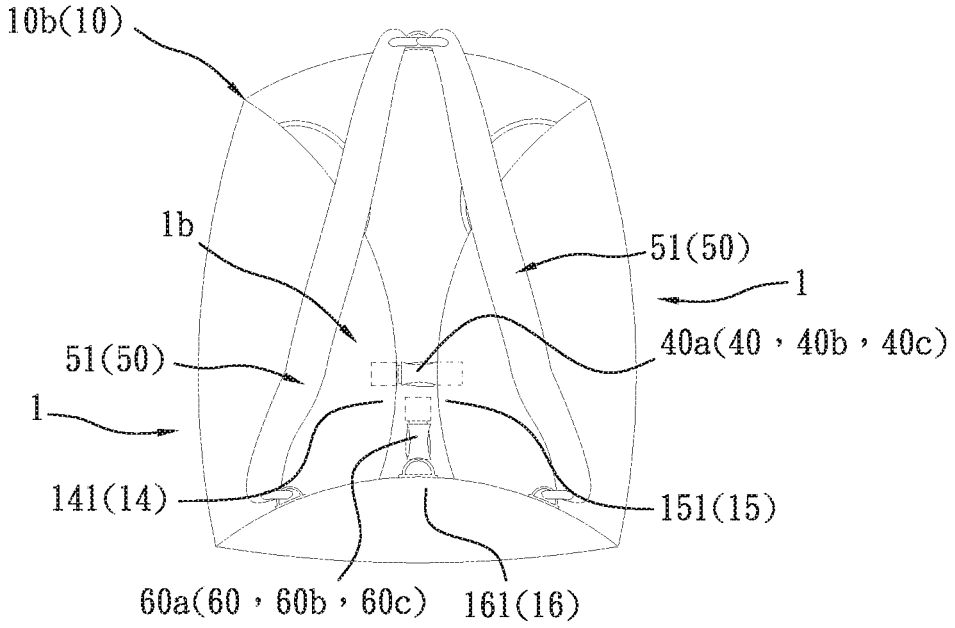
FIG. 14 is a bottom view of the embodiment in FIG. 11 already folded and having straps on a front side thereof (backpack body) according to the present invention.

Refer to FIG. 5, FIG. 12 and FIG. 14, after the bottom folding area 16 being folded to the middle portion 13, a bottom edge portion 161 of the bottom folding area 16 is connected to the middle portion 13 by a second connection member 60 so as to keep the bottom folding area 16 in the folded state over the middle portion 13.

Refer to FIG. 12 and FIG. 14, the second connection member 60 can be designed into different types such as a side release buckle 60*a*, a hook-and-loop fastener 60*b*, or a button 60*c*. The respective types of the second connection member 60 can be, but not limited, formed by a male part and a female part respectively arranged at the bottom edge portion 161 of the bottom folding area 16 and the middle portion 13. The side release buckle 60*a*, the hook-and-loop fastener 60*b*, or the button 60*c* are generally known to people skilled in the art so that they are not described in details and shown in figures.

Refer to FIG. 1 and FIG. 15, the shape of the float body 10 can be circular 10*c* (as shown in FIG. 1) or U-shaped 10*d* (as shown in FIG. 15).

Refer to FIG. 1, the float body 10 further includes a mounting groove 17 provided with an opening facing outward and used for receiving user's objects therein no matter the float body 10 of the portable inflatable diving float 1 is floating on the water or carried on the user's back.

Refer to FIG. 1, the float body 10 further includes a cover body 18 disposed on a center thereof and used to close the opening of the mounting groove 17 for preventing the objects in the mounting groove 17 from falling off.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A portable inflatable diving float comprising:

a float body which is able to be blown up, at least one inflation valve used to inflate the float body; and at least one deflation valve used for deflation of the float body to form a flat body;

wherein the flat body is the deflated float body composed of include a horizontal portion, a vertical portion, and a middle portion which is an intersection of the horizontal portion and the vertical portion; wherein the left side and the right side of the horizontal portion of the float body are symmetrical to each other; wherein a left folding area and a right folding area are respectively formed on the left side and the right side of the horizontal portion of the float body for being folded toward the middle portion; wherein a horizontal length of the horizontal portion is reduced when the left folding area and the right folding area are simultaneously folded toward the middle portion and kept in a folded state; wherein a left edge portion of the left folding area and a right edge portion of the right folding area are connected by a first connection member after the left folding area and the right folding area being folded over the middle portion; thereby the left folding area and the right folding area are kept in the folded state over the middle portion so that the flat body formed by deflation of the float body further becomes a backpack body with smaller area; wherein least one strap member is connected between a top end and a bottom end on a front side or a back side of the float body; thus users can carry the backpack body formed by the folded flat body on their back with them by the strap member.

2. The device as claimed in claim 1, wherein the strap member includes two straps which are extending from the top end to the bottom end of the backpack body, arranged symmetrically to each other, and going over the left should and the right shoulder of a user respectively.

3. The device as claimed in claim 1, wherein the left edge portion of the left folding area and the right edge portion of the right folding area is against each other, arranged symmetrical to and spaced apart from each other, or overlapped with each other when the left edge portion of the left folding area and the right edge portion of the right folding area are connected by the first connection member and kept in the folded state.

4. The device as claimed in claim 1, wherein the first connection member includes a side release buckle, a hook-and-loop fastener, or a button.

5. The device as claimed in claim 4, wherein the side release buckle, the hook-and-loop fastener, or the button of the first connection member is formed by a male part and a female part respectively arranged at the left edge portion of the left folding area and the right edge portion of the right folding area.

6. The device as claimed in claim 1, wherein a bottom side of the middle portion of the float body is able to be folded upward to form a bottom folding area; a vertical length of the vertical portion is reduced when the bottom folding area has been folded toward the middle portion.

7. The device as claimed in claim 6, wherein after the bottom folding area being folded to the middle portion, a bottom edge portion of the bottom folding area is connected to the middle portion by a second connection member so as to keep the bottom folding area in the folded state over the middle portion.

8. The device as claimed in claim 7, wherein the connection member incudes a side release buckle, a hook-and-loop fastener, or a button.

9. The device as claimed in claim 8, wherein the side release buckle, the hook-and-loop fastener, or the button of the second connection member is formed by a male part and a female part respectively arranged at the left edge portion of the left folding area and the right edge portion of the right folding area.

10. The device as claimed in claim 1, wherein the float body is circular or U-shaped.

* * * * *